United States Patent [19]

Radloff et al.

[11] 4,195,899

[45] Apr. 1, 1980

[54] ELECTRICAL CONNECTOR WITH IMPROVED STRAIN RELIEF MEANS

[75] Inventors: Frederick J. Radloff, Northlake; Ronald F. Krolak, North Riverside, both of Ill.

[73] Assignee: Bunker Ramo Corporation, Oak Brook, Ill.

[21] Appl. No.: 834,750

[22] Filed: Sep. 19, 1977

[51] Int. Cl.[2] ..... H01R 13/58

[52] U.S. Cl. ..... 339/103 M; 339/36; 339/75 M; 339/208; 339/272 UC

[58] Field of Search ..... 339/103 R, 103 B, 103 C, 339/103 M, 104, 101, 107, 36, 75 M, 208, 272 UC

[56] References Cited

U.S. PATENT DOCUMENTS

| | | | |
|---|---|---|---|
| 3,751,579 | 8/1973 | Nojiri | 339/103 R |
| 4,035,051 | 7/1977 | Guy | 339/103 R |

FOREIGN PATENT DOCUMENTS 2406003 8/1974 Fed. Rep. of Germany .

*Primary Examiner*—Roy Lake
*Assistant Examiner*—DeWalden W. Jones
*Attorney, Agent, or Firm*—F. M. Arbuckle; P. D. Ertel

[57] ABSTRACT

An electrical connector includes a housing having a plurality of electrical contact elements disposed therein for terminating one end of an insulated conductor and a shroud securable to the connector housing to cover the electrical contact elements. Improved strain relief for the terminated conductor is provided by base clamp means securable to the housing and engageable with the conductor, and fastener clamp means engageable with the conductor and securable to the base clamp means. The base clamp means includes first detent means adjustably matable with second detent means disposed on the fastener clamp means to enable adjustable locking engagement between the base and fastener clamp means to grip the insulated conductor therebetween, the base and fastener clamp means being easily engaged or disengaged without the use of tools and adjustable relative to each other to accept conductors of different sizes. Disengagement of the base and fastener clamp means is effected by displacement of the fastener clamp means relative to the base clamp means along the axis of the terminated conductor and toward the connector housing.

34 Claims, 8 Drawing Figures

ELECTRICAL CONNECTOR WITH IMPROVED STRAIN RELIEF MEANS

BACKGROUND OF THE INVENTION

This invention relates generally to electrical connectors and more specifically to strain relief mechanisms of electrical connectors. Particularly, the subject invention relates to an improved connector strain relief mechanism which is easy to secure and remove from a terminated conductor and is readily adjustable to accommodate conductors of different sizes.

It has long been recognized that some type of strain relief mechanism is desirable, or even necessary, to mechanically secure a conductor terminated in an electrical connector. Otherwise, strain imposed on the terminated conductor due to applied tension or other severe movement may impair the electrical connection or entirely separate the conductor from the electrical contacts within the connector. Therefore, a wide variety of strain relief mechanisms have been devised for use in conjunction with electrical connectors. One such strain relief mechanism associated with a electrical connector is illustrated in U.S. Pat. No. 3,657,682, issued to Ralph Iversen on Apr. 18, 1972. This patent discloses an electrical connector having a hood secured to a housing which contains a plurality of electrical contacts. Attached to one end of the electrical connector is a strain relief mechanism which includes means for securing the hood thereto and a screw-type adjustable clamp which engages and presses the terminated conductor against the inner top surface of the hood. While this arrangement is adequate in some instances, the disclosed strain relief mechanism is somewhat cumbersome and time-consuming to secure to and disengage from the electrical conductor. Moreover, a tool is required to assemble and strain relief structure in its operative position.

Another type of prior art strain relief mechanism is disclosed in U.S. Pat. No. 3,629,803, issued to Glenn Gluntz on Dec. 21, 1971. In this disclosure, strain relief is provided by the cooperation of the connector housing and cover. However, the strain relief provided by this arrangement is insufficient for many purposes inasmuch as the terminated conductor may still be pulled away from its electrical contacts.

U.S. Pat. No. 3,055,971, issued to R. J. Lander on Sept. 25, 1962, discloses a strain relief mechanism which employs detent clips and is readily secured to the conductor. However, the disclosed mechanism suffers from distinct disadvantages in that it is not readily removable nor is it adjustable to accommodate varying sizes of electrical conductors.

U.S. Pat. No. 3,794,960, issued to Joseph Sugar on Feb. 26, 1974, and U.S. Pat. No. 3,701,5051, issued to Ferdinand Klumpp, Jr., on Oct. 31, 1972, both disclose electrical connectors having another type of strain relief mechanism which utilizes interlocking detent members. While the strain relief mechanisms disclosed in these patents are relatively quick to install and adjustable to accommodate varying sized conductors, the embodiments are not readily disengageable to permit easy and expeditious changing or addition of electrical conductors.

SUMMARY OF THE INVENTION

Therefore, it is one object of the present invention to provide an electrical connector having improved means for providing strain relief for a conductor terminated therein.

It is another object of the present invention to provide a strain relief mechanism for an electrical connector which is readily adjustable to accept conductors of different sizes.

A further object of the present invention is to provide a strain relief mechanism for an electrical connector which is easily secured to or disengaged from a conductor terminated in the connector without requiring the use of any tools.

In accordance with the invention, an electrical connector includes a housing and a plurality of electrical contact elements disposed therein for terminating an electrical conductor. The contact elements may comprise any conventional electrical contact arrangement, such as microribbon or insulation-piercing sockets, and the electrical conductor is typically a multiconductor bundle containing a plurality of individual conductor members each of which is terminated by one contact element. A shroud may also be provided for substantially covering the contact elements and the terminal portion of the electrical conductor. Preferably, the shroud is removably secured to one end of the connector housing, the second end of the shroud being movably secured to the strain relief mechanism described below.

The strain relief mechanism of the present invention includes base clamp means and fastener clamp means each of which engages the electrical conductor at its point of exit from the shroud. The base clamp means is secured to the connector housing and includes retaining means engageable with the adjacent end of the connector shroud for providing limited movement of the shroud relative to the housing. The fastener clamp means is secured to the base clamp to firmly grip the electrical conductor therebetween.

In order for the strain relief mechanism to accommodate different size conductors, first detent means are provided on the base clamp means which are adjustably mateable with similar second detent means disposed on the fastener clamp means. Each detent means preferably includes a plurality of projecting teeth which are arranged such that the teeth of the second detent means are readily matable with selected teeth of the first detent means so as to provide a number of mated and locked positions between the base and fastener clamp means. The detent teeth are further arranged so that they may be readily disengaged by displacement of the fastener clamp means along the axis of the conductor and toward the connector housing. In addition, crimping members are preferably provided on both the base and fastener clamp means to insure binding engagement of the insulated conductor therebetween.

In one preferred form, the base clamp means constitutes a bracket member and the fastener clamp means consists of a substantially U-shaped clip member, each member having a plurality of projecting teeth which form the first and second detent means. In this manner, as the clip member is inserted into the bracket member with the conductor disposed therebetween, the opposed projecting teeth engage and interlock, the clip member being pressed into the bracket member sufficiently to securely grip the insulated conductor therebetween. Any upward or outward force applied to the conductor will thus be transmitted to and borne by the clip and bracket members and not by the junction of the terminated conductor and the electrical contact elements. To disengage the strain relief mechanism from the conductor, the clip member is simply moved relative to the bracket member toward the connector housing along a line substantially parallel to the axis of the conductor until the mated teeth are disengaged.

BRIEF DESCRIPTION OF THE DRAWINGS

The novel features which are believed to be characteristic of the invention are set forth in the appended claims. The invention itself, however, together with further objects and attendant advantages thereof, will become apparent and best understood in the following detailed description taken in connection with the accompanying drawings, setting forth by way of illustration and example certain embodiments of the invention, in which:

DETAILED DESCRIPTION OF THE PREFERRED EMBODIMENTS

Figure 1:
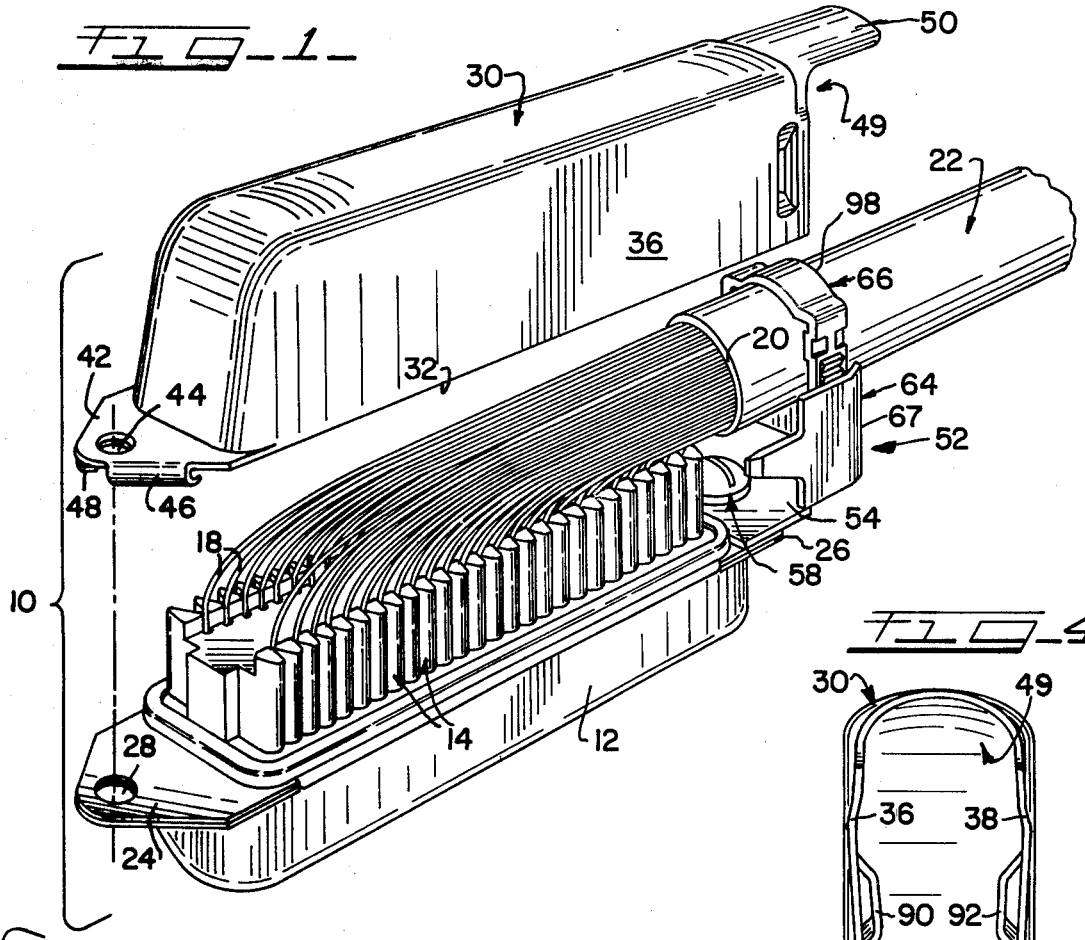
FIG. 1 is a front perspective view of an electrical connector constructed in accordance with the present invention and illustrating one embodiment of a strain relief mechanism assembled with an insulated conductor terminated in the connector, the shroud of the connector being removed for illustrative purposes.
Figure 4:
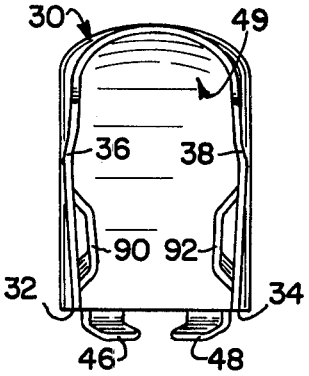
FIG. 4 is a rear elevation view of a shroud taken substantially along line 4—4 of FIG. 2.
Figure 2:
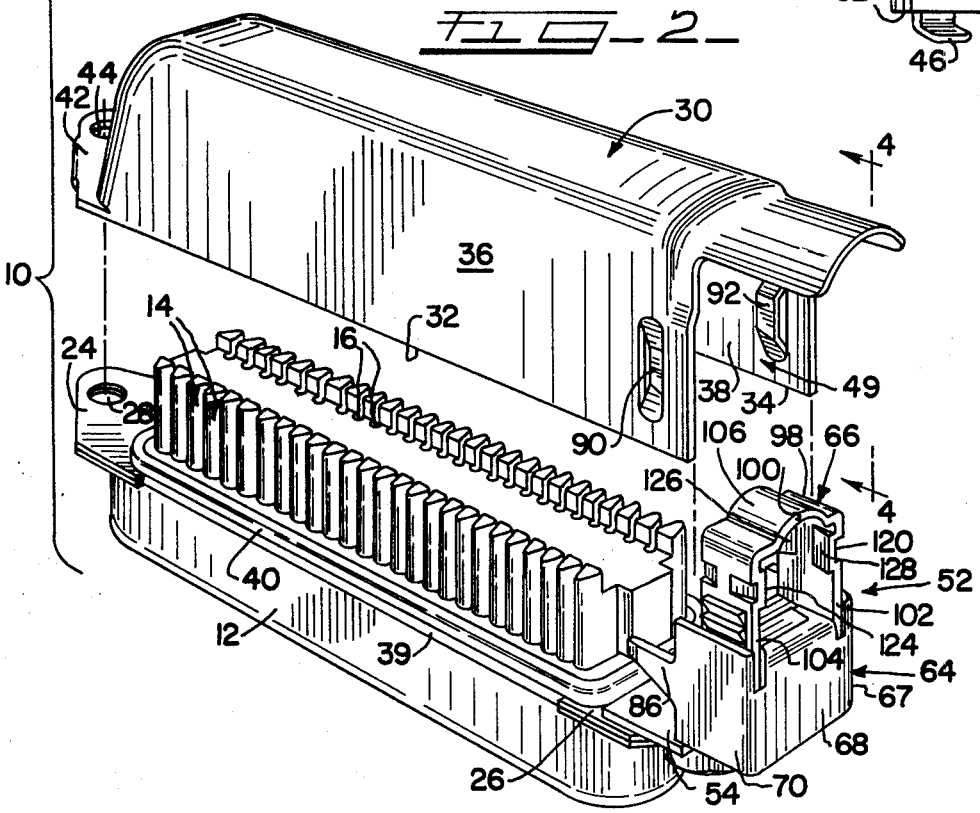
FIG. 2 is a rear perspective view of the embodiment illustrated in FIG. 1 without the insulated conductor.
Figure 3:
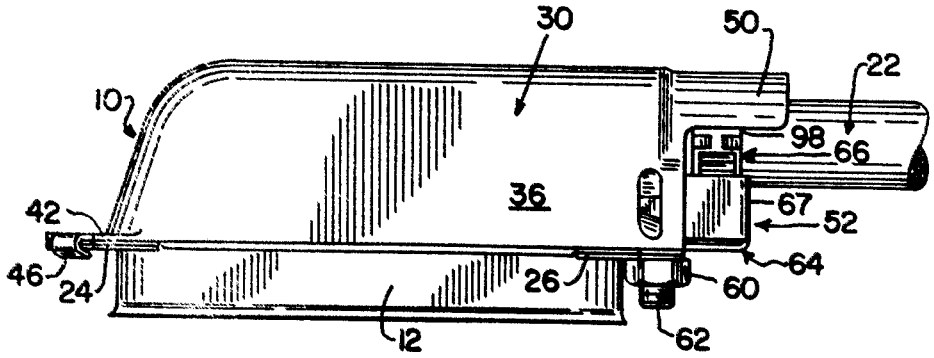
FIG. 3 is a side elevation view of the embodiment illustrated in FIG. 1 with the shroud assembled to the connector in its operative position.

Referring to FIGS. 1 through 4, an electrical connector 10 is illustrated having a housing 12 and a plurality of electrical contact elements 14 disposed therein. In preferred form, the electrical contact elements 14 comprise a plurality of insulation-piercing sockets 16 adapted to receive and electrically engage the terminal ends of a plurality of individual conductors 18 which are bound together by any conventional dielectric insulating material 20 to form an insulated conductor 22. It should be noted that the contact element arrangement illustrated herein is conventional and that the present invention is not limited thereto.

In preferred form, the housing 12 includes substantially identical end flanges 24 and 26 extending outwardly from the ends thereof. The end flange 24 includes an aperture 28, while the end flange 26 includes a similar aperture (not shown). A shroud 30 is secured to the top of the housing 12 so as to substantially enclose the contact elements 14 and the terminal end of conductor 22. The shroud 30 is sized and shaped so that the bottom edges 32 and 34 of the sides 36 and 38, respectively, will fit snugly against ledges 39 formed along the upper outer edge of housing 12. Preferably, the bottom edges 32 and 34 of the shroud sides 36 and 38 are angled slightly towards each other to bias the lower portions of the shroud sides 36 and 38 against an upper lip 40 which projects upwardly from the housing 12 and surrounds the contact elements 14. In this manner, the shroud 30 is maintained snugly in place.

Projecting from the closed forward end of the shroud 30 is an end tab 42 sized and shaped to cooperate with the housing end flange 24 when the shroud 30 is secured to the housing 12. The end tab 42 includes an aperture 44 which aligns with the aperture 28 when the shroud 30 is assembled with the housing 12. The apertures 44 and 28 are provided so that a conventional fastening means, such as a nut and bolt (not illustrated), may optionally be used to secure the tab 42 and the end flange 24 together or to mount the assembled connector to a support structure. To insure that the shroud 30 is held in place of the housing 12, stop flanges 46 and 48 are provided and project slightly forwardly from the end tab 42 and then downwardly and rearwardly so that the ends of the stop flanges 46, 48 are disposed below and spaced apart from the bottom surface of the end tab 42, as clearly illustrated in FIG. 4. The space between the ends of the stop flanges 46, 48 and the bottom surface of the end tab 42 is approximately equal to the thickness of the end flange 24 so that the end flange 24 may snugly slip between the stop flanges 46, 48 and the end tab 42 when the shroud 30 is assembled with the housing 12. Thus, the forward end of the shroud 30 is securely held to the housing 12 with or without utilizing the aforementioned optional fastening means in the apertures 44 and 28.

The rearward end of the shroud 30 is open to form passage 49 which accommodates the insulated conductor 22 entering into the shroud 30. In the illustrated form, the rear end of the shroud 30 includes a shroud extension 50 which projects rearwardly from the passage 49 to cover and protect the strain relief means 52 described in detail below.

Figure 5:
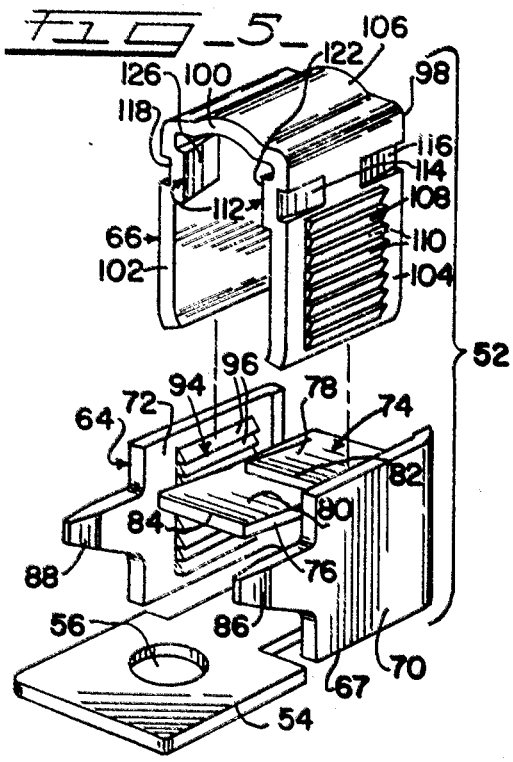
FIG. 5 is an enlarged, exploded front perspective view of the strain relief mechanism constructed in accordance with the present invention and shown in FIGS. 1 and 2.
Figure 6:
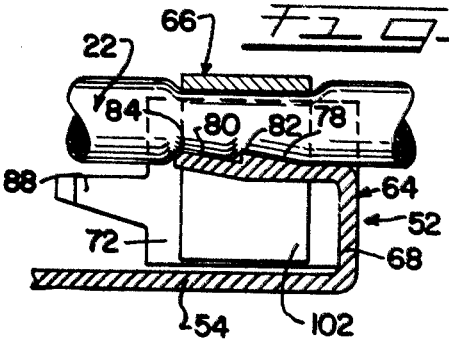
FIG. 6 is a side elevational view, with some parts in elevation, of the embodiment illustrated in FIG. 5 with the components assembled in their operative arrangement.

Turning more specifically to one embodiment of the strain relief means 52 particularly illustrated in FIGS. 5 and 6, the strain relief means 52 preferably includes a base clamp means 64 and a fastener clamp means 66 which in preferred form completely encircle the conductor 22 when joined together. However, other variations of the strain relief means 52 that only partially encircle the conductor 22 may be utilized if the conductor 22 is nevertheless firmly gripped thereby. The base clamp means 64 preferably comprises a bracket member 67 which includes a base flange 54 with an aperture 56. The base flange 54 is sized and shaped so as to fit onto the upper surface of the housing end flange 26 with the aperture 56 aligned with an aperture (not shown) in the end flange 26. Any conventional fastener means 58 may be employed to secure the base flange 54 to the end flange 26, such as the nut 60 and the bolt 62 illustrated in FIGS. 1 and 3. The bracket 67 further includes a back wall 68 projecting upwardly from the distal end of the base flange 54, and two sidewalls 70 and 72 are secured to the back wall 68 at their rearward edge. Sidewalls 70 and 72 are substantially perpendicular to and freestanding from the base flange 54.

Means 74 for crimping and clamping the insulated conductor 22 within the strain relief means 52 includes, in the presently illustrated embodiment, a cantilevered central flange 76 extending forwardly from the back wall 68 between, and spaced apart from, the sidewalls 70 and 72. The central flange 76 preferably includes upwardly angled stepped surfaces 78 and 80 which form at the ends thereof two crimping projections 82 and 84. These crimping projections 82 and 84 aid in bindingly retaining the conductor 22 within the strain relief means 52 when the conductor 22 is subjected to axial tension loads.

Projecting from the forward side edges of the sidewalls 70 and 72 are two retaining tongue members 86 and 88 which are sized and shaped to engage a pair of catches 90, 92 which project inwardly from the inner sidewalls 36 and 38, respectively, of the shroud 30. Preferably, each tongue member 86, 88 is angled slightly toward its opposed tongue member so as to create an inward bias against the catches 90 and 92 when engaged therewith. In this manner, the tongue members 86 and 88 retain the rearward end of the shroud 30.

To securely engage and retain the fastener clamp means 66 with the base clamp means 64, first detent means 94 are disposed on each sidewall 70 and 72. In the preferred form, the first detent means 94 comprise a plurality of elongated teeth 96 projecting inwardly from the inner surface of each sidewall 70 and 72. Each elongated tooth 96 is angled downwardly and is aligned along a line substantially parallel to the central axis of the insulated conductor 22 when the conductor 22 is secured within the strain relief means 52.

The fastener clamp means 66 preferably comprises a substantially U-shaped clip member 98 having an upper curved bight 100 and two depending legs 102 and 104. In the illustrated form, the bight 100 includes a rippled portion 106 which aids in fitting the insulated conductor 22 within the U-shaped clip 98. Each depending leg 102, 104 is preferably angled slightly outwardly from its opposed leg and includes detent means 108 which, in preferred form, comprises a plurality of elongated, upwardly inclined, substantially parallel teeth 110 projecting from the outer surfaces of the legs 102, 104. The teeth 110 are aligned substantially parallel with the central axis of the insulated conductor 22 when the conductor 22 is inserted within the strain relief means 52 and are sized and shaped to cooperate with the teeth 96 of the first detent means 94. As the legs 102, 104 of clip member 98 are inserted into the bracket 67 between the sidewalls 70 and 72, the teeth 110 of the second detent means 108 engage the teeth 96 of the first detent means 94, and the more that the clip 98 is pressed into the bracket 67, the greater the number of the teeth 110 which mate with the teeth 96. Therefore, the clip 98 may be adjusted to a plurality of positions relative to the bracket 67 so as to increase or decrease the spacing between the bight 100 of the clip 98 and the central flange 76 of the bracket 67. In this manner, a variety of insulated conductors 22 having varying diameters may be expeditiously secured within the strain relief means 52. Furthermore, the slight outward angle of each leg 102, 104 insures firm engagement between the teeth 110 and the teeth 96.

Once the teeth 110 have engaged the teeth 96, the clip 98 may not be pulled upwardly relative to the bracket 67 due to the interlocking of the inclined teeth 110 and 96. Furthermore, the back wall 68 prevents removal of the clip 98 by moving the clip 98 rearwardly away from the connector housing 12. However, the clip 98 may be readily disengaged from the bracket 67 by displacing the clip 98 relative to the bracket 67 forwardly toward the connector housing 12 and generally along the longitudinal axis of the conductor 22. Since the teeth 110 and the teeth 96 are both substantially parallel with the insulated conductor 22, they are substantially parallel with each other and therefore may move relative to each other in a longitudinal direction.

The U-shaped clip 98 further includes means 112 for crimping and binding the conductor 22 and which preferably include two angularly indented portions 114 and 116 disposed on the depending leg 104, and two similarly indented portions 118 and 120 disposed on the depending leg 102. Each of these indented portions forms a crimping projection on the inner surface of the legs 102 or 104, as illustrated at 122, 124, 126 and 128. These projections crimp the insulated conductor 22 when the conductor 22 is positioned within the clip 98 between the legs 102 and 104 and the bight 100 to aid in holding the conductor 22 therein.

In operation, the base flange 54 of the bracket member 67 is secured by the fastening means 58 to the end flange 26 of the connector housing 12. The electrical conductor 22 is then laid across the central flange 76 of the base clamp means 64, and the individual conductors 18 are terminated within the contact elements 14. The fastener clamp means 66 is then placed about the insulated conductor 22 and slidably adjusted until the second detent means 108 on the legs 102, 104 are in vertical alignment with the first detent means 94 of the bracket member 67. The clip 98 is then depressed to its fullest extent so that the teeth 110 and 96 inter-engage and the insulated conductor 22 is firmly held within the strain relief means 52. Once the clip 98 is assembled in its final position, the termination of the conductor 22 within the contact elements 14 is substantially isolated from tension loads applied to the conductor 22, or other severe distortion of the conductor, with loads and distortion being transmitted to and borne by the strain relief means 52. However, the conductor 22 may be removed from engagement with the strain relief means 52 by simply displacing the clip 98 forwardly toward the housing 12 and thereby disengaging the teeth 110 from the teeth 96. Since the clip 98 firmly engages the conductor 22 via the projections 122, 124, 126 and 128, the axial displacement of the clip may be effected by simply pushing on the conductor.

Once the strain relief means 52 has fully engaged the insulated conductor 22, the shroud 30 may be slidably mounted on the housing 12 so that the edges 32, 34 of the shroud sidewalls 36 and 38 are in snug engagement with the shelf 39 of the housing 12, the tongue members 86 and 88 are engaged with the catches 90, 92 of the shroud 30, and the stop flanges 46 and 48 are fully engaged with the end flange 24 of the housing 12. In this manner, the shroud 30 is snugly held on housing 12, there being a slight amount of free play at the junction between the tongue members 86, 88 and the catches 90, 92 for the reasons described above.

Figure 7:
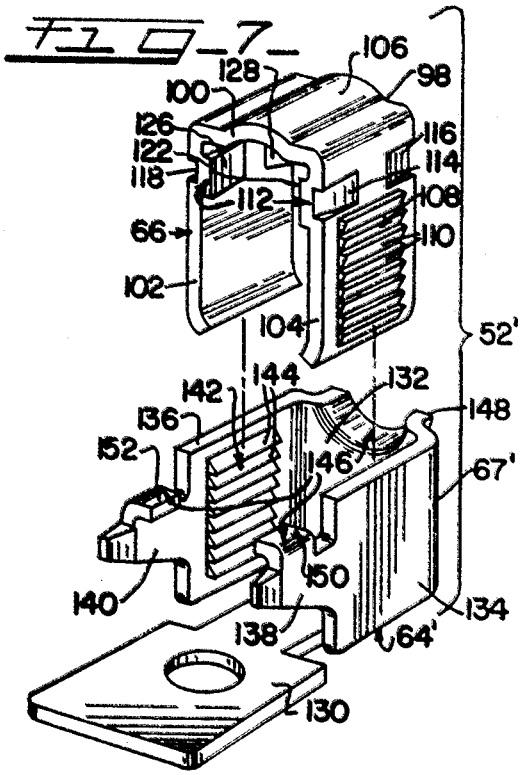
FIG. 7 is an enlarged, exploded front perspective view of a second embodiment of a strain relief mechanism constructed in accordance with the present invention.
Figure 8:
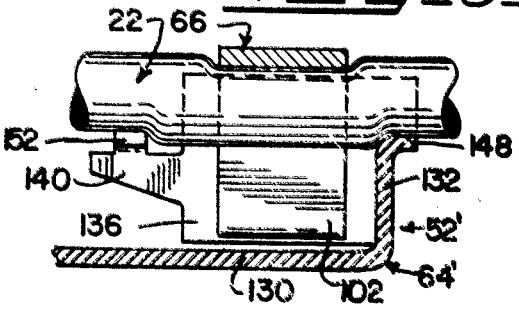
FIG. 8 is a side sectional view of the embodiment illustrated in FIG. 7 showing the components thereof assembled in their operative position.

Turning now to a different embodiment of the strain relief means 52' illustrated in FIGS. 7 and 8, it should be noted that like numbers for like parts are utilized throughout this specification. In this particular embodiment, the strain relief means 52' includes a somewhat different base clamp means 64' and a fastener clamp means 66 identical with the previously described embodiment. It is envisioned, however, that the form of the fastener clamp means 66 may be varied somewhat without departing from the scope of the present invention, such as by eliminating the crimping means 112 or by locating the second detent means on the inner surfaces of the leg portions 102 and 104. In such a situation, however, additional variations to the base clamp means 64 or 64', as by locating the first detent means on the outer surfaces of the sidewalls 70, 72, should be made and are also considered within the scope of the present invention.

The base clamp means 64' includes a bracket 67' which has a base flange 130, a back wall 132 secured to the distal end of the base flange 130, and two substantially parallel sidewalls 134 and 136 secured at their rearward edges to the back wall 132 and extending forwardly therefrom substantially perpendicular to the base flange 130. Extending forwardly from the forward edge of each sidewall 134 and 136 are tongue members 138 and 140, respectively. The tongue members 138 and 140 perform the same function and in the same manner as the tongue members 86 and 88 of the previous embodiment. Disposed on the inner surfaces of the sidewalls 134 and 136 are detent means 142 which preferably include a plurality of elongated, substantially parallel, downwardly inclined teeth 144 projecting inwardly therefrom. The teeth 144 are substantially identical to and function in the same manner as the teeth 96 of the previous embodiment.

Also provided on the bracket 67' are means 146 for crimping and binding the conductor 22 which differ from the crimping means 74 of the previous embodiment. The crimping means 146 includes curved lip portion 148 which projects rearwardly from the back wall 132. The projecting lip 148 is sized and shaped to receive a lower portion of the insulated conductor 22. The crimping means 146 also include two crimping projections 150 and 152 which are secured, respectively, to the tongue members 138 and 140. The projection 150 extends slightly upwardly from the tongue member 138 and then inwardly toward the tongue member 140 and the projection 152. Likewise, the projection 152 extends slightly upwardly from the tongue member 140 and then inwardly toward the tongue member 138 and the projection 150. These projections 150 and 152 extend inwardly a distance sufficient to engage the lower portion of the insulated conductor 22 when the insulated conductor 22 is laid across and engaged by the base clamp means 64'. The lip 148 and the projections 150, 152 aid in maintaining the insulated conductor 22 securely in place within the strain relief means 52'.

As can be seen from FIGS. 5 to 8, both the base clamp means 64 and 64' and the fastener clamp means 66 may be readily formed from a single sheet of metal by conventional means such as cutting, stamping and bending. Any desired material and any manner of forming the strain relief means 52 or 52' may be utilized. Furthermore, it will be appreciated that the base flanges 54 and 130 of the base clamp means 52 and 52' may be integrally formed with the connector housing 12, thereby eliminating the need for fastening means 58.

As can be seen from the above, the present invention provides a very simple and inexpensive yet versatile and effective means for affording strain relief to a conductor terminated within a connector. The strain relief means of the present invention permits a conductor to be terminated within an electrical connector while reducing the possibility of subsequent impairment of the electrical connection between the conductor and the electrical connector due to tension loads applied to the conductor. Furthermore, the strain relief mechanism of the present invention is readily adjustable to accommodate a wide variety of conductor sizes without requiring any adjustment to the mechanism itself. Also, the subject strain relief mechanism may be secured to the conductor rapidly and firmly, yet it may be readily disengaged from the conductor to change or add another conductor to the conductor. Finally, there are no tools required for the assembly or disassembly of the strain relief mechanism of the present invention with the conductor.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

We claim:

1. An electrical connector comprising:

a housing including electrical contact means for terminating an electrical conductor; and means for providing strain relief for said conductor including base clamp means securable to said housing and engageable with said conductor, and fastener clamp means adjustably securable to said base clamp means and engageable with said conductor, said base clamp means including first detent means and said fastener clamp means including second detent means mateable with said first detent means, said strain relief means including means for resisting movement of said fastener clamp means in a direction away from said housing, said first and second detent means being readily disengageable by displacement of said fastener clamp means in the direction of said housing substantially along the longitudinal axis of said gripped conductor.

2. The electrical connector as described in claim 1, wherein said connector further includes shroud means securable to said housing to substantially enclose said electrical contact means therewithin.

3. The electrical connector as described in claim 2, wherein said base clamp means includes retaining means engageable with said shroud means to permit limited movement of one end of said shroud means relative to said housing.

4. The electrical connector as described in claim 3, wherein said retaining means comprises at least one tongue member projecting from said base clamp means, and said shroud means includes at least one catch member for engagement with said tongue member.

5. The electrical connector as described in claim 1, wherein said base clamp means includes crimping means for binding said electrical conductor when said conductor is gripped between said base and fastener clamp means.

6. The electrical connector as described in claim 1, wherein said fastener clamp means includes crimping means for binding said electrical conductor when said conductor is gripped between said base and fastener clamp means.

7. The electrical connector as described in claim 1, wherein said first and second detent means each comprise a plurality of projecting teeth, the teeth of said first detent means being adjustably mateable with the teeth of said second detent means to permit said base and fastener clamp means to grip conductors of variable sizes therebetween.

8. The electrical connector as described in claim 1, wherein said base clamp means comprises a bracket having a base flange securable to said housing and two opposed sidewalls, said first detent means comprising a plurality of elongated teeth projecting from each said sidewall.

9. The electrical connector as described in claim 8, wherein said plurality of elongated teeth project inwardly from the inner surfaces of said opposed sidewalls.

10. The electrical connector as described in claim 9, wherein said movement resisting means includes a back wall secured to said base flange and to the rearward ends of said opposed sidewalls of said bracket, and said bracket further includes a cantilevered clamping flange extending forwardly from said back wall between said opposed sidewalls including crimping means disposed thereon for binding engagement with said electrical conductor when said conductor is gripped between said base and fastener clamp means.

11. The electrical connector as described in claim 9, wherein said bracket further includes a back wall secured to said base flange and to the rearward ends of said sidewalls, a lip portion projecting from said back wall for engagement with said conductor, a tongue member projecting from the forward end of each of said sidewalls, and a crimping member extending inwardly from each of said tongue members for binding engagement with said electrical conductor when said conductor is gripped between said base and fastener clamp means, said back wall comprising said movement resisting means.

12. The electrical connector as described in claim 1, wherein said fastener clamp means comprises a substantially U-shaped clip member having two depending leg portions, and wherein said second detent means comprises a plurality of elongated teeth disposed on each of said leg portions, each of said leg portions including crimping means projecting inwardly therefrom for binding engagement with said electrical conductor when said conductor is gripped between said base and fastener clamp means.

13. The electrical connector as described in claim 12, wherein said plurality of teeth project outwardly from the outer surfaces of said opposed leg portions, and said crimping means comprise indented portions forming inward projections on each of said leg portions to bind said electrical conductor when said conductor is engaged within said U-shaped clip member.

14. An electrical connector with strain relief means comprising:

a connector housing including at least one electrical contact element disposed there within for terminating an insulated electrical conductor;

a shroud securable to said housing for covering said electrical contact elements; and means for providing strain relief for said conductor including a bracket member secured to said housing and engageable with said conductor, said bracket member having retaining means for engagement with one end of said shroud, and a clip member engageable with said conductor and having two depending leg portions adjustably securable to said bracket member, said bracket member including first detent means, and said depending leg portions having second detent means adjustably mateable with said first detent means to variably interlock said bracket and clip members to securely grip said conductor therebetween, said bracket member having means for resisting movement of said clip member in a direction away from said housing, said first and second detent means, when mated, being readily disengageable by displacement of said clip member relative to said bracket member in the direction of said housing substantially along the longitudinal axis of said grip conductor.

15. The electrical connector as described in claim 14, wherein said first and second detent means each comprise a plurality of elongated, projecting mateable teeth.

16. The electrical connector as described in claim 15, wherein said plurality of elongated teeth are arranged substantially parallel to the longitudinal axis of said conductor when said conductor is engaged with said strain relief means to permit disengagement of the mated detent means by longitudinal displacement of said clip member relative to said bracket member toward said housing.

17. The electrical connector as described in claim 14, wherein said shroud includes two catch members disposed on the inner surfaces of the sides thereof and said retaining means comprises two projecting tongue members engageable with said catch members to permit limited vertical movement of one end of said shroud relative to said housing.

18. The electrical connector as described in claim 14, wherein said bracket member further includes means for crimping said insulated conductor when said conductor is gripped between said clip member and said bracket member.

19. The electrical connector as described in claim 18, wherein said bracket member further comprises a base flange detachably secured to said housing, two opposed sidewalls substantially perpendicular to said base flange, a back wall secured to the rearward ends of said sidewalls, and a tongue member projecting from the forward end of each of said sidewalls for engagement with said shroud, said first detent means being disposed on each of said sidewalls, said back wall comprising said movement resisting means.

20. The electrical connector as described in claim 19, wherein said bracket member further includes a central flange secured to said back wall and projecting forwardly between said opposed sidewalls, said crimping means comprising two crimping members projecting from said central flange.

21. The electrical connector as described in claim 19, wherein said bracket member further includes a lip portion projecting rearwardly from said back wall for crimping engagement with said insulated conductor, and two opposed crimping members projecting toward each other from said tongue members to bindingly engage said insulated conductor when said conductor is gripped between said bracket and clip members.

22. The electrical connector as described in claim 14, wherein said clip member is substantially U-shaped and includes means for crimping said electrical conductor when said conductor is gripped between said U-shaped clip member and said bracket member.

23. The electrical connector as described in claim 22, wherein said crimping means comprises indented sections disposed on each of said leg portions, each of said indented sections forming an inward projection for binding engagement with said insulated conductor when said conductor is disposed between said leg portions.

24. Strain relief means for an electrical connector having electrical contact means disposed therein for terminating an electrical conductor, said strain relief means comprising base clamp means securable to said connector and engageable with said conductor, and fastener clamp means adjustably securable to said base clamp means and engageable with said electrical conductor, said base clamp means including first detent means and said fastener clamp means including second detent means mateable with said first detent means to adjustably interlock said base and fastener clamp means to grip said electrical conductor therebetween, said base clamp means including means for resisting movement of said fastener clamp means in a direction away from said connector, said first and second detent means being readily disengageable by displacement of said fastener clamp means relative to said base clamp means substantially along the longitudinal axis of said gripped conductor.

25. The strain relief means as described in claim 24, wherein said electrical connector includes shroud means for substantially covering said electrical contact means, and said base clamp means is engageable with said shroud means.

26. The strain relief means as described in claim 25, wherein said base clamp means further includes retaining means for engagement with said shroud means to permit limited movement of one end of said shroud means relative to said base clamp means.

27. The strain relief means as described in claim 26, wherein said retaining means comprises at least one tongue member projecting from said base clamp means engageable with a catch member disposed on the inner surface of said shroud means.

28. The strain relief means as described in claim 24, wherein said first and second detent means each comprise interlockable projecting teeth arranged, when mated, to be readily disengageable by longitudinal displacement of said fastener clamp means relative to said base clamp means toward said connector.

29. The strain relief means as described in claim 28, wherein said base clamp means comprises a bracket having a base flange securable to said connector, two opposed sidewalls, and means for crimping said electrical conductor when said conductor is gripped between said base and fastener clamp means, the teeth of said first detent means being disposed on the inner surface of each of said opposed sidewalls.

30. The strain relief means as described in claim 28, wherein said fastener clamp means comprises a substantially U-shaped clip member having two depending, opposed leg portions and means for crimping said electrical conductor when said conductor is gripped between said base and fastener clamp means, the teeth of said second detent means being disposed on the outer surface of each of said opposed leg portions.

31. An electrical connector with strain relief means comprising:

a connector housing including at least one electrical contact element disposed there within for terminating an insulated electrical conductor;

a shroud securable to said housing for covering said electrical contact element; and means for providing strain relief for said conductor including a bracket member secured to said housing and engageable with said conductor and a clip member engageable with said conductor and having two depending leg portions adjustably securable to said bracket member, said bracket member including a base flange detachably secured to said housing, two opposed sidewalls substantially perpendicular to said base flange, a back wall secured to the rearward ends of said sidewalls, a tongue member projecting from the forward end of each of said walls for engagement with one end of said shroud, and first detent means disposed on each of said side walls, said depending leg portions including second detent means adjustably mateable with said first detent means to variably interlock said bracket and clip members to securely grip said conductor therebetween, said bracket member having means for resisting movement of said clip member in a direction away from said housing and having means for gripping said insulated conductor when said conductor is gripped between said clip member and said bracket member, said first and second detent means being readily disengageable by displacement of said clip member relative to said bracket member in the direction of said housing substantially along the longitudinal axis of said gripped conductor.

32. The electrical connector as described in claim 31, wherein said bracket member further includes a lip portion projecting rearwardly from said back wall for crimping engagement with said insulated conductor, and two opposed crimping members projecting toward each other from said tongue members to bindingly engage said insulated conductor when said conductor is gripped between said bracket and clip members.

33. The electrical connector as described in claim 31, wherein said clip member is substantially U-shaped and includes means for crimping said electrical conductor when said conductor is gripped between said U-shaped clip member and said bracket member.

34. The electrical connector as described in claim 33, wherein said crimping means comprises indented sections disposed on each of said leg portions, each of said indented sections forming an inward projection for binding engagement with said insulated conductor when said conductor is disposed between said leg portions.

* * * * *